US005235147A

United States Patent [19]

Pham et al.

[11] Patent Number: 5,235,147

[45] Date of Patent: Aug. 10, 1993

[54] $SF_6$ CIRCUIT-BREAKER INCORPORATING BOTH A VARISTOR AND A CAPACITOR

[75] Inventors: Van Doan Pham; Joseph Martin, both of Meyzieu; Robert Jeanjean, Lyon, all of France

[73] Assignee: GEC Alsthom SA, Paris, France

[21] Appl. No.: 862,309

[22] Filed: Apr. 2, 1992

[30] Foreign Application Priority Data

Apr. 5, 1991 [FR] France ..... 91 04173

[51] Int. Cl.[5] ..... H01H 33/16; H01H 33/82

[52] U.S. Cl. ..... 200/144 AP; 200/148 A; 200/148 R

[58] Field of Search ..... 200/144 AP, 148 R, 148 A, 200/148 B, 146 R

[56] References Cited

U.S. PATENT DOCUMENTS

| | | | |
|---|---|---|---|
| 4,383,150 | 5/1983 | Cromer et al. | 200/144 AP |
| 4,421,962 | 12/1983 | Thuries et al. | 200/144 AP |
| 4,434,332 | 2/1984 | Yanabu et al. | 200/144 AP |
| 4,439,651 | 3/1984 | Thuries et al. | 200/144 AP |
| 4,636,599 | 1/1987 | Talir | 200/144 AP |
| 5,124,872 | 6/1992 | Pham et al. | 361/11 |
| 5,164,559 | 11/1992 | Pham et al. | 200/144 AP |
| 5,170,023 | 12/1992 | Pham et al. | 200/144 AP |

FOREIGN PATENT DOCUMENTS

| | | |
|---|---|---|
| 229954 | 11/1963 | Austria . |
| 0106315 | 4/1984 | European Pat. Off. . |
| 0152583 | 8/1985 | European Pat. Off. . |
| 2503448 | 10/1982 | France . |

*Primary Examiner*—J. R. Scott

*Attorney, Agent, or Firm*—Sughrue, Mion, Zinn, Macpeak & Seas

[57] ABSTRACT

A high tension circuit-breaker has an insulating case filled with a dielectric gas such as $SF_6$. A high capacitance capacitor and at least a varistor are electrically interconnected in parallel and are connected to a first terminal. The capacitor and varistor are associated with an insertion mechanism which momentarily inserts the capacitor and varistor in parallel with the arcing contacts during circuit-breaker disengagement or engagement. The insulating case is extended by at least one conductive case housing both the capacitor and at least part of the varistor.

14 Claims, 4 Drawing Sheets

$SF_6$ CIRCUIT-BREAKER INCORPORATING BOTH A VARISTOR AND A CAPACITOR

The present invention relates to a high tension circuit-breaker including at least one interrupting chamber per phase, each chamber comprising a gastight cylindrical insulating case filled with a gas having good dielectric properties such as sulfur hexafluoride ($SF_6$) and containing a fixed permanent contact, a fixed arcing contact, and moving equipment including permanent contacts and arcing contacts, each chamber further comprising a blast piston and cylinder, and a blast nozzle.

BACKGROUND OF THE INVENTION

Circuit-breakers of this type are used for interrupting high line fault currents, and often require the presence of capacitance at their terminals.

Such a circuit-breaker is described in French Patent Application 90 13 176, where a capacitor and a varistor in series with a resistor are disposed inside the case, are electrically interconnected in parallel, are connected via a common first point to a first terminal, and are associated with a mechanism enabling them to be momentarily inserted in parallel with the arcing contacts during circuit-breaker disengagement or engagement.

The dispositions described in that Patent Application are suitable for capacitors having capacitances no greater than 5,000 pF.

For capacitances greater than 5,000 pF, those dispositions are not suitable, given the dimensions of the capacitors. It is difficult to house this type of capacitor inside the standard-size insulating case of the circuit-breaker.

SUMMARY OF THE INVENTION

In order to solve this problem, the present invention provides that the insulating case is extended by at least one conductive case housing both the capacitor and at least part of the varistor and/or resistor.

In a first variant, the conductive case is constituted by a metal cap closing the insulating case.

Preferably, the varistor and/or resistor is constituted by a stack of components, which stack is disposed inside an insulating tube and is electrically connected to the cap via a first end and to the insertion mechanism via a second end.

In a first disposition, a first end of the capacitor is electrically connected to the cap and the second end of the capacitor is electrically connected to the varistor and/or resistor via a conductor component.

In a first embodiment, the conductor component is constituted by at least one rod in contact both with the second end of the capacitor and with the insertion mechanism.

In a second embodiment, the conductor component is a tube which is coaxial to the varistor and/or resistor, and which is in contact both with the second end of the capacitor and with the insertion mechanism.

In this case, the capacitor may be made up of a stack of capacitor components disposed inside an insulating tube.

In a second disposition, the capacitor is tubular and is coaxial to the varistor and/or resistor.

In this case, the conductor component is preferably a tube which is coaxial to the varistor and/or resistor, and which is in contact both the second end of the capacitor and with the insertion mechanism.

In a second variant, two cylindrical conductive cases extend the insulating case, the common axis of the two conductive cases being perpendicular to the axis of the insulating case.

Preferably, one of the conductive cases houses the varistor and/or resistor, and the other houses the capacitor, the conductive cases being connected to the first terminal, and one end of the varistor and/or resistor and one end of the capacitor being connected to their respective cases.

In this case, a conductor piece disposed along the axis of the insulating case electrically connects the other end of the capacitor and the other end of the varistor and/or resistor to the insertion mechanism.

BRIEF DESCRIPTION OF THE DRAWINGS

Embodiments of the invention are described by way of example with reference to the accompanying drawings, in which.

DETAILED DESCRIPTION

Figure 1:
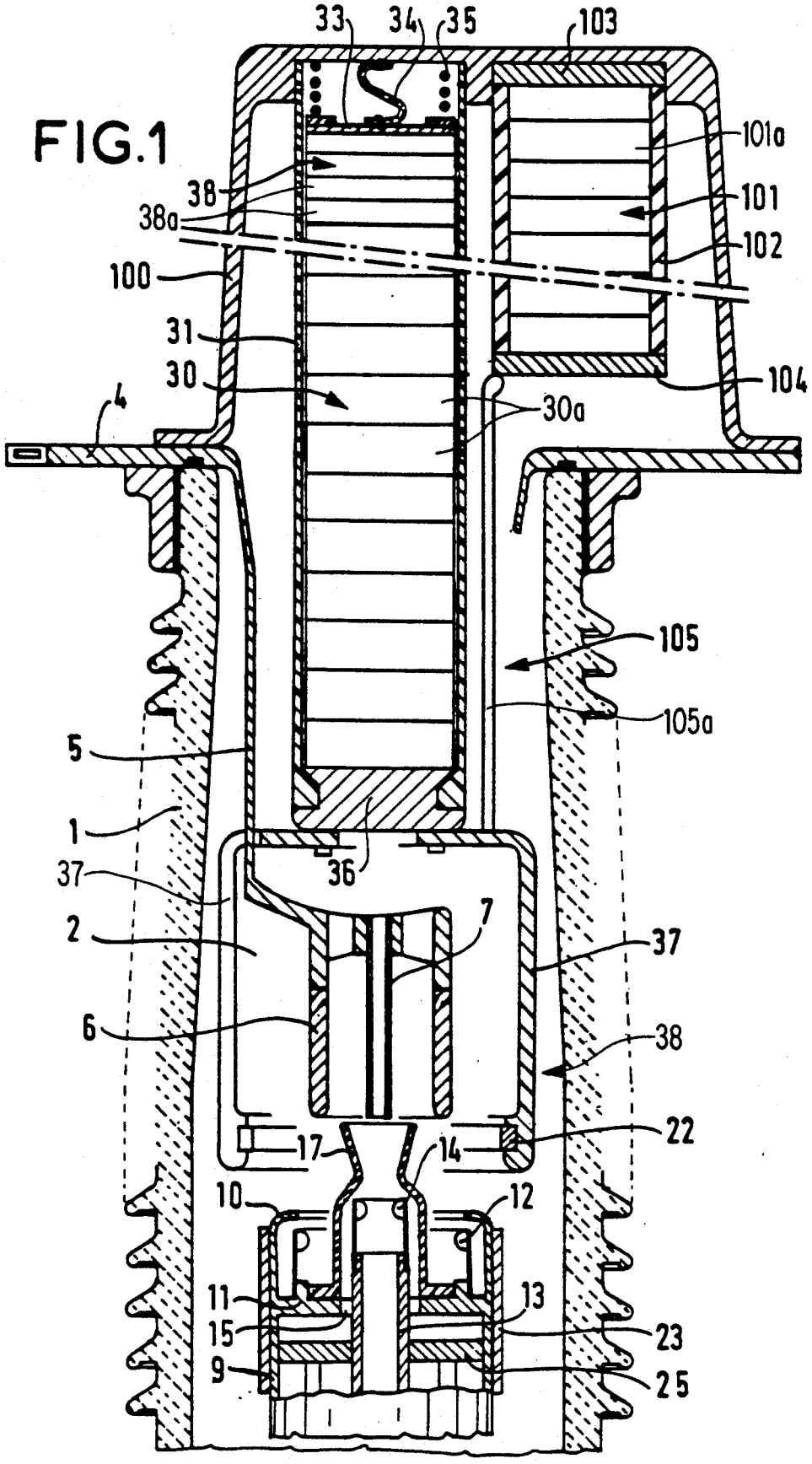
FIG. 1 is a fragmentary view in longitudinal section of an interrupting chamber having a capacitor and forming a first embodiment of the invention.

In the various embodiments, like elements have like numerical designations. In FIG. 1, reference 1 designates an insulating case, preferably made of porcelain, delimiting a volume 2 containing the interrupting components of the circuit-breaker. The insulating case is closed at one end by a metal cap 100 fixed to a metal collar which constitutes a first terminal and which is extended inside the casing by arms 5. A first metal tube 6 constituting the fixed main contact, and a coaxial second tube 7 constituting the fixed arcing contact are fixed to the first terminal 4.

The volume 2 is filled with a gas having good dielectric properties, such as sulfur hexafluoride, under a pressure of a few bars.

The moving equipment of the circuit-breaker comprises a metal tube 9 extended by an anti-corona cap 10 and equipped with a transverse metal partition 11 carrying contact fingers 12 constituting the moving main contact, and a tube 13 extended by contact fingers 14 constituting the moving arcing contact. The partition 11 has through holes 15 to allow the blast gas to pass therethrough, and carries a blast nozzle 17 made of an insulating material. Blasting is provided by a fixed piston 25 disposed inside the tube 9. The tube 9 is connected to a second terminal of the circuit-breaker via sliding contacts (not shown).

The circuit-breaker is shown in its disengaged position.

The cap 100 houses a varistor indicated generally at 30; made up of components **30*a*, and a series resistor indicated generally at 38 made up of components 38*a*, the components 30*a* and 38*a* being stacked inside an insulating tube 31**.

The varistor components **30*a* may be based on zinc oxides (ZnO) or silicon carbide (SiC). The resistor components 38*a*** may be based on carbon.

The tube 31 is fixed to the top of the metal cap 100 closing the top of the interrupting chamber. A metal plate 33 connected to the cover 100 via a braiding 34 overlies the stack of components and is pressed against the stack by a spring 35 which bears against the top of the cap.

The bottom of the tube 31 is closed by a metal block 36 carrying arms 37. A metal ring 22, e.g. made of copper, engagable with the electrode 23 to insert the varistor, is fixed on the ends of said arms forming an insertion mechanism indicated generally at 38.

The capacitor indicated generally at 101 is housed in the metal cap 100 beside the varistor 30 and the resistor 38.

The capacitor 101 is made up of a stack of capacitor components 101*a* disposed inside an insulating tube 102. The capacitor components 101*a* may be made up of metal sheets separated by very thin insulating sheets impregnated with oil or in an $SF_6$ environment.

The top of the tube 102 is closed by a metal plate 103 electrically connecting the capacitor 101 to the cap 100, and thus to the first terminal 4. The bottom of the tube 102 is closed by a metal plate 104 electrically connecting the other end of the capacitor 101 to the bottom end of the varistor 30 via a conductor component 105 constituted by at least one rod 105*a* and via the arms 37 of the insertion mechanism 38.

When the circuit-breaker is in the engaged position, the ring 22 is in contact with the electrode 23 so that the capacitor 101, the varistor 30 and the resistor 38 are connected in parallel to the terminals of the circuit-breaker.

During disengagement, the electrode 23 moves with the moving equipment away from the ring 22 and down towards the bottom of the figure, so that the capacitor, the varistor and the resistor are disconnected when the circuit-breaker is in the disengaged position.

The varistor serves to limit voltage surges, and the high value capacitor serves to lengthen the delay time of the transient recovery voltage, and to reduce the oscillation frequency of the line voltage during interruption of a short-distance fault.

Figure 2:
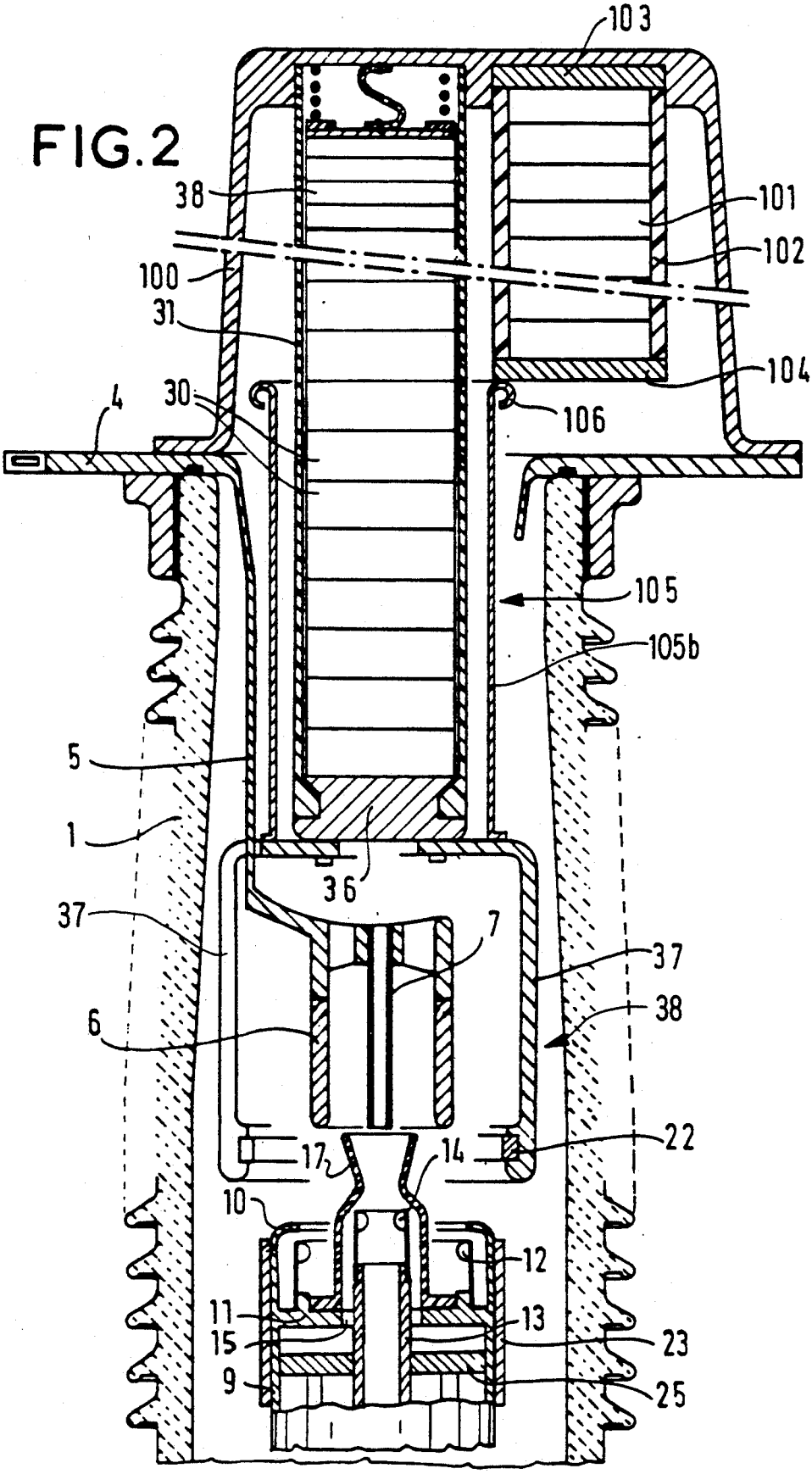
FIG. 2 is an analogous view showing a second embodiment thereof.

FIG. 2 shows another embodiment of the invention in which the conductor component 105 is constituted by a tube 105*b*, which is coaxial to the insulating tube 31 and which bears against the insertion mechanism arms 37.

The tube 105*b* is thin and its end nearest the capacitor has an anti-corona ring 106. This disposition makes it possible to improve the voltage gradients between the varistor 30 and the tube 105, and between the tube 105*b* and the collar 4.

Figure 3:
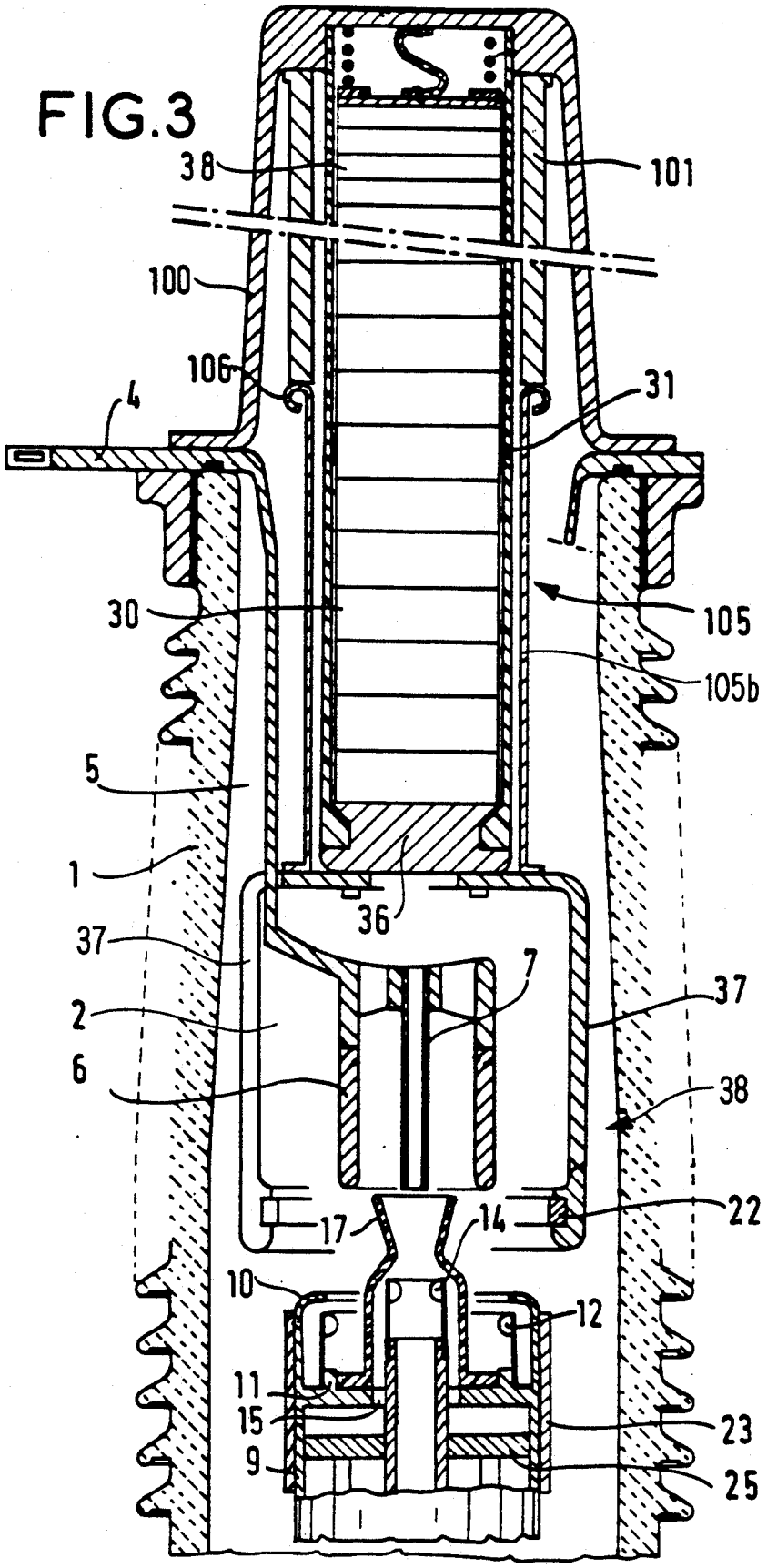
FIG. 3 is an analogous view showing a third embodiment thereof.

In a third embodiment of the invention shown in FIG. 3, the capacitor 101 is tubular and is disposed coaxially to the insulating tube 31 and concentric about the insulating tube. The capacitor 101 is electrically connected to the insertion mechanism 38 by means of the tubular conductor component 105 provided with an anti-corona ring 106. This embodiment enables a smaller-sized cap 100 to be used.

Figure 4:
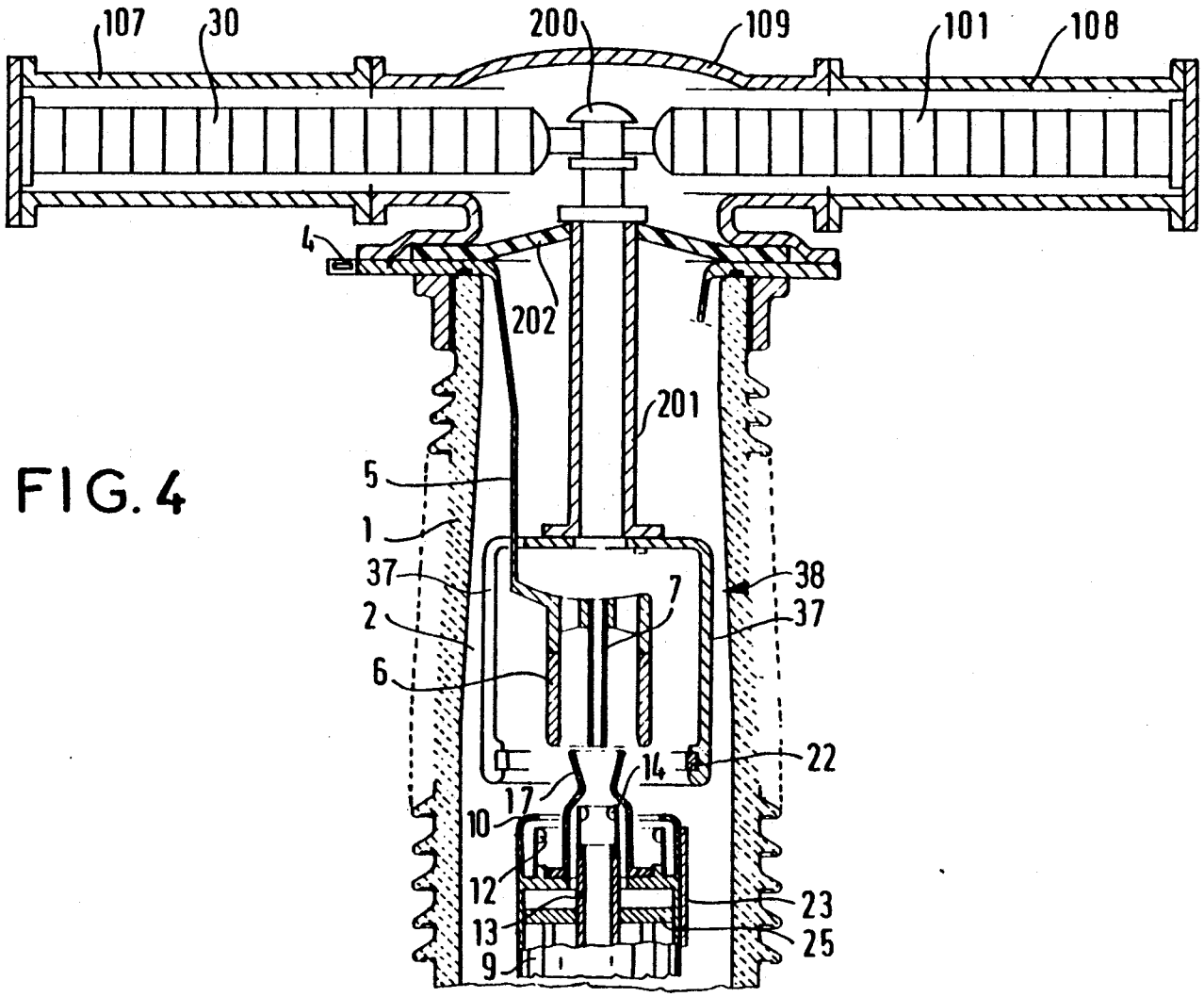
FIG. 4 is an analogous view a fourth embodiment thereof.

A fourth embodiment of the invention is shown in FIG. 4. The varistor 30, optionally which may be associated with a resistor, and the capacitor 101 are disposed entirely outside the insulating case 1 made of a porcelain. The varistor 30 and the capacitor 101 are disposed perpendicular to the axis of the case 1, i.e. in a horizontal position.

The varistor 30 and the capacitor 101 are housed in respective conductive cylindrical cases 107, 108, the two metal cases 107, 108 being interconnected by a metal central member 109 connected to a first terminal 4.

One end of the varistor 30 and one end of the capacitor 101 are connected to their respective cases 107, 108. The central other ends are connected to a connection piece 200 electrically connected to a contact tube 201 on which the insertion mechanism 38 is mounted.

The tube 201 is fixed to an insulating cone 202 mechanically fixed between the metal member 109 and the collar 4. The insulating cone 202 is provided with a communication hole (not shown) to allow the dielectric gas to pass therethrough.

This fourth embodiment makes it possible to have particularly large varistors and capacitors, while significantly reducing the overall height of the circuit-breaker.

We claim:

1. In a high tension circuit-breaker including at least one interrupting chamber per phase, each chamber comprising a gastight cylindrical insulating case filled with a gas having good dielectric properties and containing: a first terminal mounted to one end of said insulating case, a fixed permanent contact and a fixed arcing contact connected to said first terminal, and moving equipment including movable permanent contacts and arcing contacts movable into contact respectively with said fixed permanent contact and said fixed arcing contact, each chamber further comprising a blast piston and cylinder, and a blast nozzle, the improvement wherein said circuit-breaker includes a high capacitance capacitor and at least a varistor, means electrically interconnecting said capacitor and said varistor in parallel to a said first terminal, and an insertion means within said chamber for momentarily inserting said capacitor and varistor in parallel with said arcing contacts during circuit-breaker disengagement or engagement, and wherein said insulating case is extended by at least one conductive case housing both said capacitor and at least part of said varistor.

2. A circuit-breaker according to claim 1, wherein the conductive case comprises a metal cap closing off said one end of the insulating case.

3. A circuit-breaker according to claim 2, wherein the varistor is constituted by a stack of components, said stack being disposed inside an insulating tube and being electrically connected to said cap via a first end of the varistor and to the insertion means via a second end of the varistor.

4. A circuit-breaker according to claim 3, wherein a first end of the capacitor is electrically connected to the cap and said second end of the capacitor is electrically connected to the varistor via a conductor component.

5. A circuit-breaker according to claim 4, wherein the conductor component is constituted by at least one rod in contact both with the second end of the capacitor and with said insertion means.

6. A circuit-breaker according to claim 4, wherein the conductor component is a tube which is coaxial to the varistor, and which is in contact both with the second end of the capacitor and with the insertion means.

7. A circuit-breaker according to claim 4, wherein the capacitor is tubular and is coaxial to the varistor.

8. A circuit breaker according to claim 7, wherein the conductor component is a tube which is concentric about the varistor, and which is in contact with both the second end of the capacitor and the insertion means.

9. A circuit-breaker according to claim 1, wherein the capacitor is made up of a stack of capacitor components disposed inside an insulating tube.

10. A circuit-breaker according to claim 1, wherein two coaxial cylindrical conductive cases extend the insulating case, and a common axis of the two conductive cases is perpendicular to the axis of the insulating case.

11. A circuit-breaker according to claim 10, wherein one of the conductive cases houses the varistor, and a second conductive case houses the capacitor, the conductive cases are connected to the first terminal, and one end of the varistor and one end of the capacitor are connected to respective conductive cases.

12. A circuit-breaker according to claim 11, wherein a conductor piece disposed along the axis of the insulating case electrically connects the second end of the capacitor and a second end of the varistor to the insertion means.

13. A circuit-breaker according to claim 1, wherein said momentary inserting means comprises a metal block engaging said varistor and including arms supporting a metal ring, and a metal tube of said moving equipment movable axially towards and away from said metal ring, and including an electrode mounted to said metal tube and engaging said metal ring during circuit-breaker closing.

14. In a high tension circuit-breaker including at least one interrupting chamber per phase, each chamber comprising a gastight cylindrical insulating case filled with a gas having good dielectric properties and containing: a first terminal mounted to one end of said insulating case, a fixed permanent contact and a fixed arcing contact connected to said first terminal, and moving equipment including movable contacts and arcing contacts movable into contact respectively with said fixed permanent contact and said fixed arcing contact, each chamber further comprising a blast piston and cylinder, and a blast nozzle, the improvement wherein said circuit-breaker includes a high capacitance capacitor, a varistor in series with a resistor, means for electrically interconnecting said capacitance in parallel with said series connected varistor and resistor to said first terminal, and insertion means within said chamber for momentarily inserting said capacitor and said varistor in series with said resistor in parallel with said arcing contacts during circuit-breaker disengagement or engagement, and wherein said insulating case is extended by at least one conductive case housing both the capacitor and at least part of said series connected varistor and resistor.

* * * * *